US008054251B2

(12) United States Patent
Kim et al.

(10) Patent No.: US 8,054,251 B2
(45) Date of Patent: Nov. 8, 2011

(54) METHOD FOR DRIVING FLAT PANEL DISPLAY

(75) Inventors: Seong Joong Kim, Seoul (KR); Ho Min Lim, Seoul (KR); Young Soo Han, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1358 days.

(21) Appl. No.: 11/434,819

(22) Filed: May 17, 2006

(65) Prior Publication Data

US 2006/0262051 A1 Nov. 23, 2006

(30) Foreign Application Priority Data

May 17, 2005 (KR) ..... 10-2005-0041204

(51) Int. Cl.
*G09G 3/30* (2006.01)

(52) U.S. Cl. ..... 345/77; 345/76; 345/204

(58) Field of Classification Search ..... 345/76–84, 345/211, 204, 690
See application file for complete search history.

(56) References Cited

U.S. PATENT DOCUMENTS 6,650,308 B2 * 11/2003 Kawashima ..... 345/76
7,333,078 B2 * 2/2008 Lai et al. ..... 345/76
7,471,269 B2 * 12/2008 Ushigusa et al. ..... 345/76
2003/0038760 A1 * 2/2003 Kim et al. ..... 345/76
2005/0024297 A1 2/2005 Shin
2005/0099412 A1 * 5/2005 Kasai ..... 345/204

FOREIGN PATENT DOCUMENTS

CN 1591104 A 3/2005
EP 1 347 436 A2 9/2003
EP 1517290 A2 3/2005

OTHER PUBLICATIONS

Search Report issued Nov. 30, 2009 in corresponding European Application No. 06010197.9.
Search Report issued Feb. 15, 2010 in corresponding European Application No. 06010197.9.

* cited by examiner

*Primary Examiner* — Duc Dinh
(74) *Attorney, Agent, or Firm* — Morgan, Lewis & Bockius LLP

(57) ABSTRACT

A method for driving a flat panel display to improve an image quality and a lifetime of the flat panel display is disclosed. The method for driving the flat panel display includes the steps of: a) storing electric-charges contained in a parasitic capacitor of a data line and a pixel-storage capacitor (Cst) in each pixel via a pixel transistor connected to the data line, which enters a floating state during a predetermined time other than a light-emitting time caused by a data-current writing operation, until a current voltage reaches a threshold voltage of the pixel transistor; and b) performing the writing of a data current corresponding to a pixel to be driven by the data line via the pixel transistor, such that the flat panel display emits light.

3 Claims, 6 Drawing Sheets

| Non-light-emitting phase | Current driving phase |
| --- | --- |

METHOD FOR DRIVING FLAT PANEL DISPLAY

This application claims the benefit of Korean Patent Application No. P2005-41204, filed on May 17, 2005, which is hereby incorporated by reference as if fully set forth herein.

BACKGROUND OF THE INVENTION

1. Field of the Invention

The present invention relates to a method for driving a flat panel display, and more particularly to a method for driving an organic electro-luminescent (EL) panel display such that it improves an image quality and an effective lifetime of the organic EL panel display.

2. Discussion of the Related Art

Generally, the organic EL display electrically excites a fluorescent organic compound, such that it emits light. The organic EL display drives N×M organic EL cells using a voltage or current signal, such that it displays a desired image.

A conventional organic EL display will hereinafter be described with reference to FIG. 1.

FIG. 1 is a structural diagram illustrating a conventional organic EL display.

Referring to FIG. 1, the conventional organic EL display cell includes an anode composed of an ITO, an organic thin film, and a cathode layer composed of a metal.

The organic thin film is configured in the form of a multi-layered structure, which includes an Emitting Layer (EML), an Electron Transport Layer (ETL), and a Hole Transport Layer (HTL), such that it improves light-emitting efficiency due to the balancing of electrons and holes. Also, the organic thin film further includes an Electron Injecting Layer (EIL) and a Hole Injecting Layer (HIL).

The above-mentioned organic EL cell is classified into a Passive Matrix (PM)—based organic EL cell and an Active Matrix (AM)—based organic EL cell. The PM-based organic EL cell forms an anode and a cathode orthogonal to each other according to an addressing scheme, and selects a desired line, such that it is driven. The AM-based organic EL cell connects a Thin Film Transistor (TFT) and a capacitor to each ITO pixel electrode, and maintains a voltage by capacitance, such that it is driven.

The PM-based organic EL cell or the AM-based organic EL cell is classified into a voltage-write scheme and a current-write scheme according to the type (i.e., voltage or current) of a signal received from a drive circuit.

FIG. 2 is a circuit diagram illustrating a pixel structure of a conventional AM-OLED (Organic Light Emitting Diode) panel. FIG. 2 is a conventional AM voltage-write pixel circuit for driving an OLED using the TFT, and shows a representative example of N×M pixels.

Referring to FIG. 2, a current-drive-type transistor (Mb) is connected to the OLED, such that a current signal for emitting the light is written in the OLED.

In this case, the current capacity of the current-drive-type transistor (Mb) is controlled by a data voltage received via a switching transistor (Ma). In order to maintain the data voltage during a predetermined period of time, the capacitor is connected between a source and a gate of the current-drive-type transistor (Mb).

The N-th selection signal line (Select[n]) is connected to the gate of the switching transistor (Ma), and a data line (Data[m]) is connected to the source of the switching transistor (Ma).

Operations of the pixel having the above-mentioned structure will hereinafter be described with reference to FIG. 2.

If the switching transistor (Ma) is switched on by the selection signal (Select[n]) applied to the gate of the switching transistor (Ma), a data voltage (V DATA) is applied to a gate (Node A) of the drive-type transistor (Mb) via the data line.

In response to the data voltage (V DATA) applied to the Node A, the current signal is written in the OLED via the drive-type transistor (Mb), resulting in the implementation of the light-emitting operation.

The conventional method for driving the OLED having the above-mentioned structure may unexpectedly change the brightness between pixels due to a threshold-voltage deviation and a mobility deviation of the drive-type transistor, such that it may unavoidably deteriorate uniformity of a display screen.

Also, due to the power (P=I*V) consumed by the pixel and the heat generated by the power, the drive-type transistor and the OLED are deteriorated, and their lifetimes are reduced, such that it is difficult for the conventional OLED to be made commercially available.

SUMMARY OF THE INVENTION

Accordingly, the present invention is directed to a method for driving a flat panel display that substantially obviates one or more problems due to limitations and disadvantages of the related art.

An object of the present invention is to provide a method for driving a flat panel display, which improves uniformity and contrast of a display screen during the operation of the flat panel display, and at the same time increases an effective lifetime of the flat panel display.

Another object of the present invention is to provide a method for driving a DEMUX-type display panel according to a cross-drive scheme or a division-drive scheme, such that it improves uniformity, image quality, and an effective lifetime of the display panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for driving a flat panel display comprises the steps of: a) storing electric-charges contained in a parasitic capacitor of a data line and a pixel-storage capacitor (Cst) in each pixel via a pixel transistor connected to the data line, which enters a floating state during a predetermined time other than a light-emitting time caused by a data-current writing operation, until a current voltage reaches a threshold voltage of the pixel transistor; and b) if the current voltage reaches the threshold voltage, performing the writing of a data current corresponding to a pixel to be driven by the data line via the pixel transistor, such that the flat panel display emits light.

Preferably, the step a) includes the step of: a1) transmitting a pre-charging voltage to both the parasitic capacitor of the data line and the storage capacitor of each pixel before the data line enters the floating state, thereby performing a pre-charging operation.

Preferably, the pre-charging voltage is less than the threshold voltage of the pixel transistor, Preferably, the steps a), b), and a1) are repeatedly driven for each frame.

Preferably, the step a) includes a predetermined OFF time having no light-emitting operation.

Preferably, when the step b) is executed at any one of a plurality of data lines, the step a) begins at another data line, such that the step a) and the step b) are cross-driven.

Preferably, the pre-charging step may be executed before the threshold voltage is stored.

Preferably, the pre-charging step may be executed before a waveform signal is applied to another data line.

In another aspect of the present invention, there is provided a method for driving a flat panel display in cross-driving a plurality of data-line sets comprising the steps of: a) performing a pre-charging operation of a first data-line set; b) applying a data waveform signal to a pixel transistor of a second data-line set, and allowing a pixel transistor connected to the first data-line set to enter a floating state; and c) applying a data waveform signal to the pixel transistor of the first data-line set.

In yet another aspect of the present invention, there is provided a method for driving a flat panel display comprising the steps of: a) allowing a pixel transistor connected to a data line of the flat panel display to enter a floating-OFF state, such that a storage capacitor is discharged; and b) applying a driving current signal to each pixel via the data line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Prior to describing the present invention, it should be noted that most terms disclosed in the present invention correspond to general terms well known in the art, but some terms have been selected by the applicant as necessary and will hereinafter be disclosed in the following description of the present invention. Therefore, it is preferable that the terms defined by the applicant be understood on the basis of their meanings in the present invention.

A method for driving a flat panel display according to the present invention will hereinafter be described with reference to the annexed drawings.

For the convenience of description and better understanding of the present invention, a method for driving the AM-OLED panel according to the present invention will be described as compared to the conventional method for driving the AM-OLED panel.

According to the present invention, the OLED will be described as a representative current-drive-type light-emitting diode.

The present invention relates to a display equipped with an OLED panel. More particularly, the present invention relates to a method for driving a large-area and high-gray-level OLED display panel using a TFT and a single-crystal silicon transistor.

Figure 1:
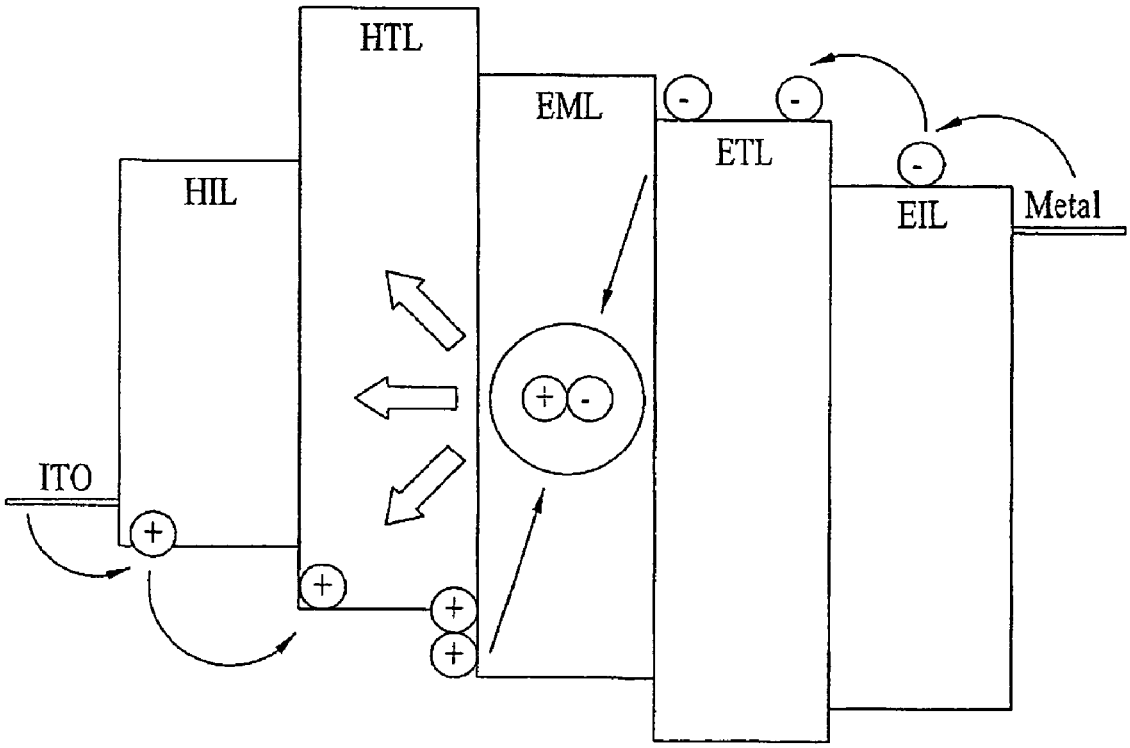
FIG. 1 Prior Art
FIG. 1 is a structural diagram illustrating a conventional OLED.
Figures 2, 3:
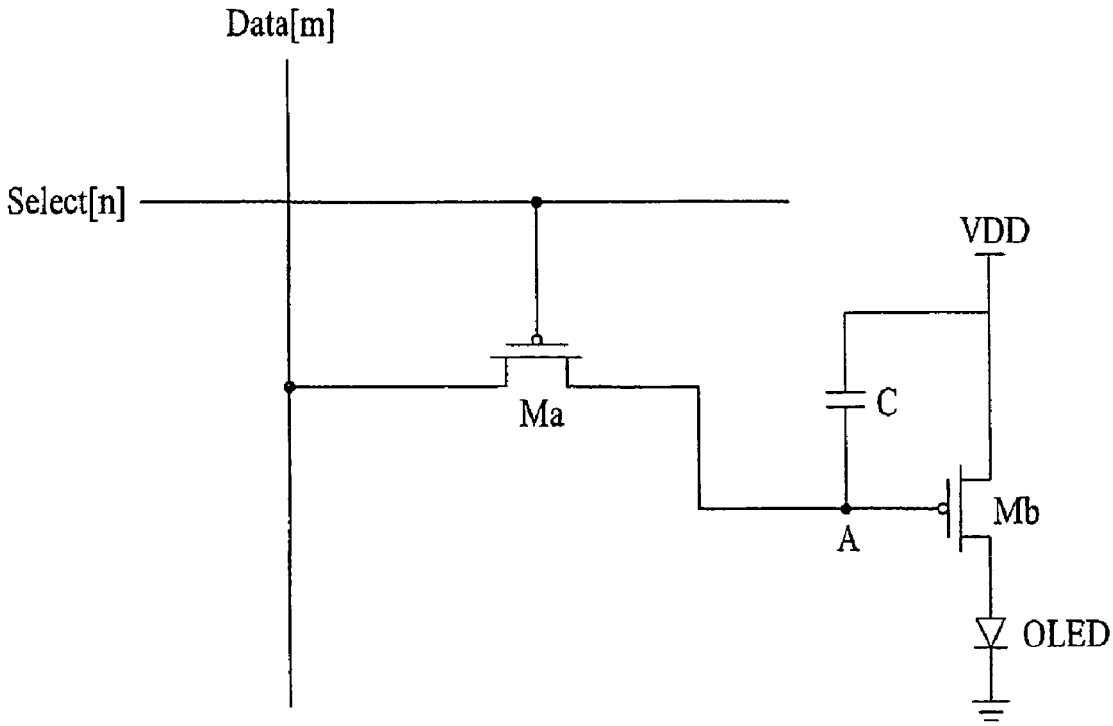
FIG. 2 Prior Art
FIG. 2 is a circuit diagram illustrating a pixel structure of a conventional AM-OLED.
FIG. 3 is a conceptual diagram illustrating a method for driving a flat panel display according to the present invention.
Figure 4:
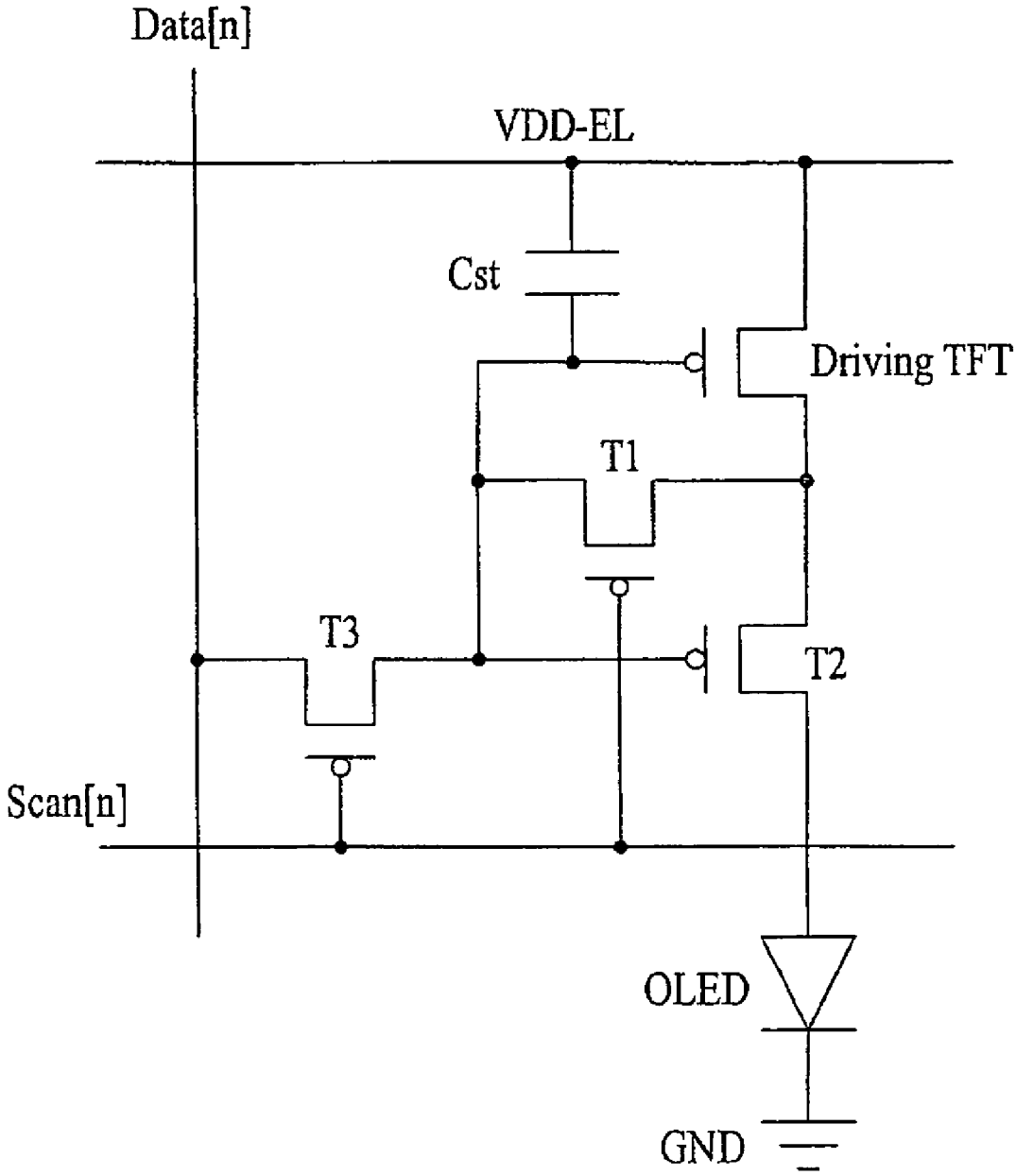
FIG. 4 is a circuit diagram illustrating an AM-OLED pixel structure according to a preferred embodiment of the present invention.

FIG. 3 is a conceptual diagram illustrating a method for driving a flat panel display according to the present invention. FIG. 4 is a circuit diagram illustrating an AM-OLED pixel structure according to a preferred embodiment of the present invention.

FIG. 3 is a conceptual diagram of a single pixel unit. Each pixel is classified into a light-emitting phase and a non-light-emitting phase. The present invention is characterized in that a threshold voltage is stored or pre-charged during the non-light-emitting phase or time, and the resultant threshold voltage is stored.

The non-light-emitting phase or time is indicative of a time other than the OLED light-emitting time caused by a data-current writing operation.

A detailed description of the pixel unit shown in FIG. 3 will be described with reference to FIG. 4. A specific case, in which the pre-charging operation is performed during the non-light-emitting time and at the same time a threshold voltage is stored, will be exemplarily described.

FIG. 4 shows an internal structure of a single pixel. A method for driving the flat panel display by applying the inventive concept of FIG. 3 to the above-mentioned pixel structure will hereinafter be described.

The conventional method for driving the flat panel display performs a pre-charging operation within the above-mentioned light-emitting time, and at the same stores a threshold voltage. Therefore, a current-drive phase caused by the writing operation of a data current for an actual light-emitting operation is reduced, such that the light-emitting operation is abnormally executed, resulting in the occurrence of image-quality deterioration.

Also, the light-emitting operation caused by the data-current writing operation must occur within a given period of time, such that the step for performing the pre-charging simultaneously with storing a threshold voltage is insufficiently executed. As a result, uniformity of each pixel is not achieved, and a brightness lifetime of each pixel is shortened.

In order to improve the image quality and provide a uniform brightness and an increased lifetime, the present invention proposes a method for performing pre-charging of each pixel simultaneously with storing a threshold voltage during the given non-light-emitting time, such that only the light-emitting operation caused by the data-current writing operation during the light-emitting time is executed to solve the problems of the conventional art.

Referring to FIG. 3, the present invention is mainly classified into a light-emitting phase and a non-light-emitting phase. If a data driver transmits a pre-charging voltage to a data line, a parasitic capacitor of the data line and a storage capacitor of each pixel form a pre-charging voltage (i.e., a pre-charging phase).

Thereafter, the data line enters a floating state (also called a float-state), and the data line and the pixel-storage capacitor are charged with electricity via the pixel transistor, having a diode structure, connected to the data line.

In this case, the above-mentioned electric-charging operation is continuously executed until a current voltage reaches a threshold voltage, and the aforementioned operation is called a "Vth Saving Phase".

If the data line and the pixel-storage capacitor are sufficiently charged with electricity during the above-mentioned non-light-emitting phase, and a current voltage reaches the threshold voltage of the pixel transistor, the non-light-emitting phase is switched to the light-emitting phase. As a result, a current signal is received in the data line via the switched-ON pixel transistor during the light-emitting phase, each pixel emits light at a specific brightness proportional to the received current signal, and the aforementioned operation is called a "Current Driving Phase".

Each pixel emits light during the non-light-emitting phase and the light-emitting phase, and the aforementioned phases are sequentially repeated for each frame, such that uniform brightness and high-contrast of each pixel are implemented. Also, since the pre-charging operation is sufficiently executed and the threshold voltage is stored, a constant OFF period is created, resulting in the implementation of increased brightness/lifetime of the OLED.

According to another objective of the present invention, the method for driving a display panel can also be applied to a cross-drive operation of a MUX-type flat panel display, and a detailed description thereof will hereinafter be described with reference to FIGS. 5~6.

It should be noted that basic structures of the above-mentioned MUX-type flat panel display are equal to those of FIG. 4.

Figure 5:
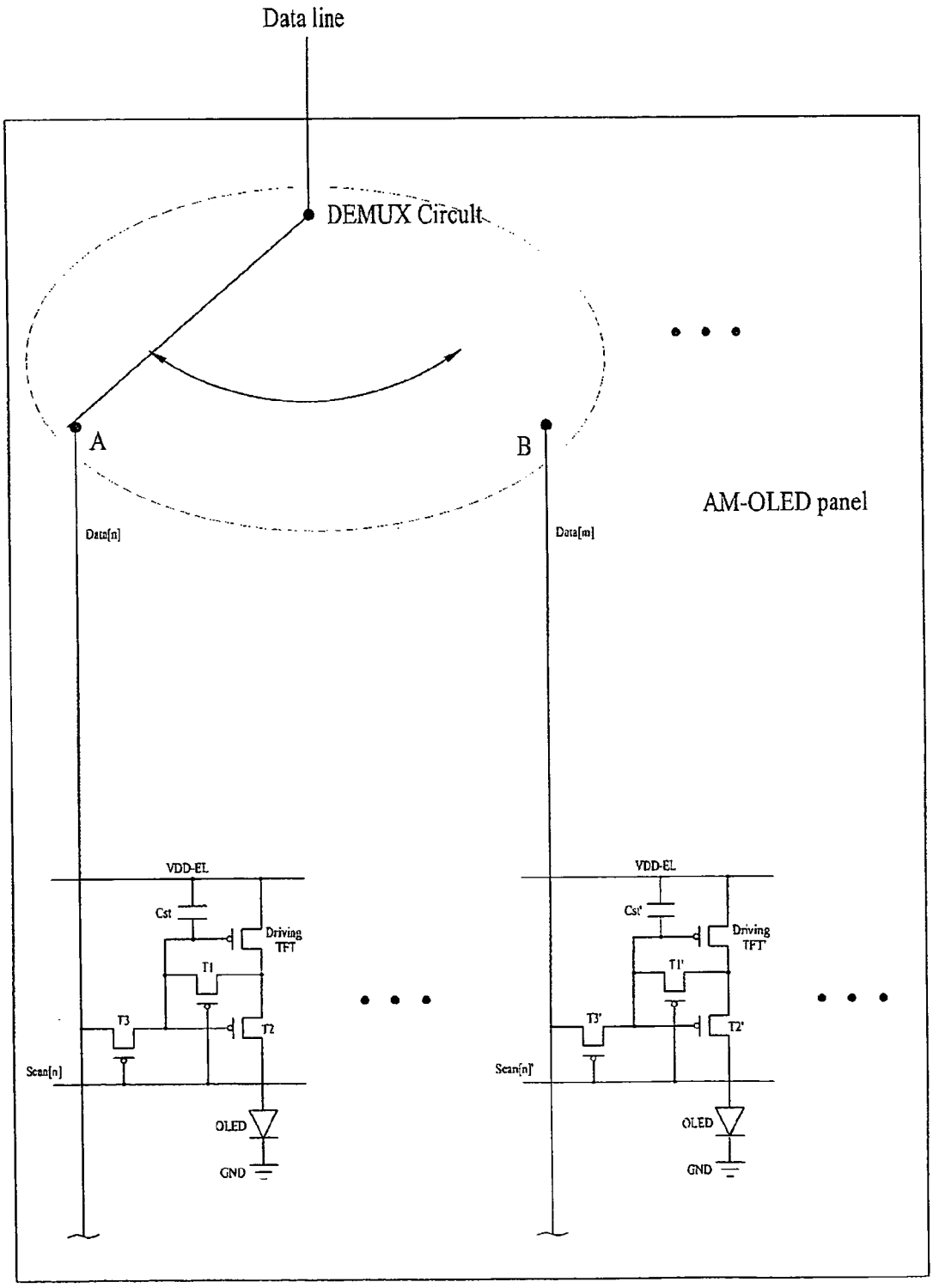
FIG. 5 is a circuit diagram illustrating an AM-OLED panel according to a preferred embodiment of the present invention.

However, differently from FIG. 4, the MUX-type flat panel display of FIG. 5 cross-drives the data line using a MUX (Multiplexer) circuit contained in a plurality of data lines, instead of connecting the data line to each pixel.

FIG. 5 is a circuit diagram illustrating an AM-OLED panel designed to drive the panel equipped with the pixel structure of FIG. 4 using the MUX circuit. FIG. 6 is a timing diagram illustrating a method for driving the AM-OLED panel of FIG. 5 according to the present invention.

A preferred embodiment will be described with reference to FIGS. 5~6. It is assumed that the present invention includes the step for performing the pre-charging operation simultaneously with storing the threshold voltage, and the number of pixels connected to the MUX circuit of FIG. 5 is set to "2" for the convenience of description and better understanding of the present invention.

Figure 6:
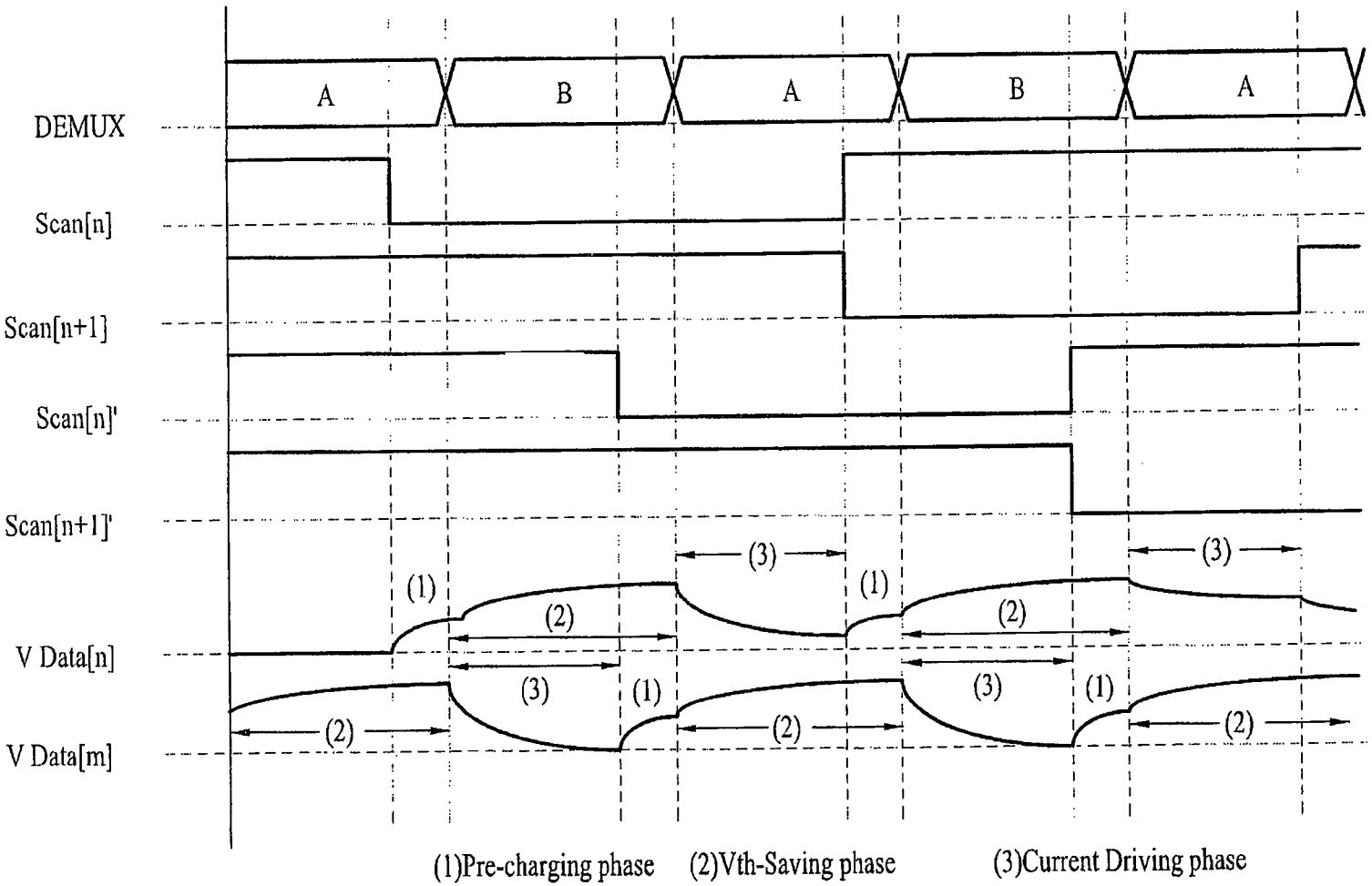
FIG. 6 is a timing diagram illustrating a method for driving a flat panel display according to the present invention.

Referring to FIG. 6, the MUX circuit cross-selects two data lines A and B.

There are two scan lines SCAN[n] and SCAN[n]' received from the gate driver. The scan line SCAN[n] provides a scan signal associated with the pixel connected to the data line A. The scan line SCAN[n+1] is indicative of the next scan signal associated with the aforementioned data line A.

The scan line SCAN[n]' provides the scan signal associated with the pixel connected to the data line B. The scan line SCAN[n+1]' is indicative of the next scan signal associated with the data line B.

A reference symbol "V Data(n)" is indicative of a drive waveform for each time zone in association with the data line A. A reference symbol "V Data(n)" is indicative of a drive waveform for each time zone in association with the data line B.

Operations of the circuit shown in FIG. 5 in association with individual phases will be described with reference to FIG. 6.

Firstly, the pre-charging phase acting as the first phase will be described.

If the MUX circuit of FIG. 5 selects the data line A during the pre-charging phase, at the same time the voltage of the N-th scan line is reduced, transistors T1 and T3 are switched on, and a pre-charging voltage is transmitted from the data driver to the data line of the MUX circuit, the data line and the storage capacitor (Cst) are charged with a pre-charging voltage.

In this case, the transistor T2 and the switched-ON transistor T1 have a diode structure, the T2 transistor is switched off, such that the OLED element is also switched off.

The present invention is characterized in that the pre-charging voltage is lower than the threshold voltage of a driving TFT.

Generally, the pre-charging operation indicates that electricity is pre-charged to compensate for an insufficient data charging operation due to slow response characteristics of the pixel. Compared with the conventional method for applying a pre-charging voltage higher than a threshold voltage of the driving TFT, the present invention applies a pre-charging voltage lower than the threshold voltage of the driving TFT, such that the present invention prevents the data current from flowing into the data line before the capacitor (Cst) is sufficiently charged with electricity. Also, the present invention can maintain uniform brightness due to the sufficient electric-charging operation.

In this case, the above-mentioned pre-charging phase may be omitted as necessary.

The "Vth Saving Phase" acting as the second phase for storing the threshold voltage will hereinafter be described.

The MUX circuit shown in FIG. 5 selects the data line B during the Vth-Saving phase, such that the data line A enters the floating state.

In this case, the N-th scan line's voltage is reduced in the same manner as in the aforementioned pre-charging phase, such that transistors T1 and T3 are switched on.

The electric charges contained in both the parasitic capacitor of the data line of the floating state and the pixel-storage capacitor are applied to the driving TFT and the T1 transistor, which have the diode structure, such that the electric-charging operation stops operation if the data-line voltage and the storage-capacitor voltage satisfy a predetermined condition denoted by "{VDD-EL−Vdata(=VCst)}=Vth_driving TFT (i.e., threshold voltage of the driving TFT)", which is in case of using a PMOS TFT.

If the negative value sign of the Vth of PMOS TFT is not considered, the predetermined condition is denoted by "{VDD-EL−Vdata(=VCst)}=−Vth_driving TFT". That is, the storage-capacitor voltage condition is denoted by "Vdata (=VCst)=VDD-EL+Vth", which is also applicable in case of using an NMOS TFT.

If the data line and the storage capacitor are sufficiently charged with electricity, the aforementioned "Vth-Saving phase" is changed to the "Current Driving Phase" acting as the third phase.

The MUX circuit of FIG. 5 re-selects the data line A during the Current-Driving phase. The N-th scan line's voltage is reduced in the same manner as in the above-mentioned first and second phases, such that the T1 and T3 transistors are switched on.

During the above-mentioned Current Driving phase, a data current signal corresponding to the pixel to be driven by the data line is transmitted from the driving TFT to the data line via the transistors T1 and T3, such that a gate-to-source voltage corresponding to the corresponding data current value is formed at the parasitic capacitor of the data line and the storage capacitor of the pixel by the driving TFT having a diode structure.

The N-th scan line's voltage is increased during the above-mentioned third phase, the voltage formed by the aforementioned increased voltage is stored in the storage capacitor, a corresponding current signal is applied to the OLED, such that the OLED emits light and the light-emitting operation of the OLED is maintained until reaching the next frame.

The above-mentioned first to third phases are repeatedly driven for each frame, such that a desired image is displayed on the screen.

The MUX-type AM-OLED panel shown in FIG. 5 is cross-driven as can be seen from FIG. 6, such that it can be driven without generating unnecessary time-consumption.

The aforementioned driving method according to the present invention can also be applied to not only the pixel structure of FIG. 4 but also all of current-drive-type pixel structures.

The present invention is characterized in that the current-drive-type pixel structure has the Pre-Charging phase, the Vth-Saving phase, and the Current-Driving phase.

In this case, the Pre-Charging phase can be omitted as previously stated above, and a detailed description thereof will hereinafter be described with reference to FIG. 7.

Figure 7:
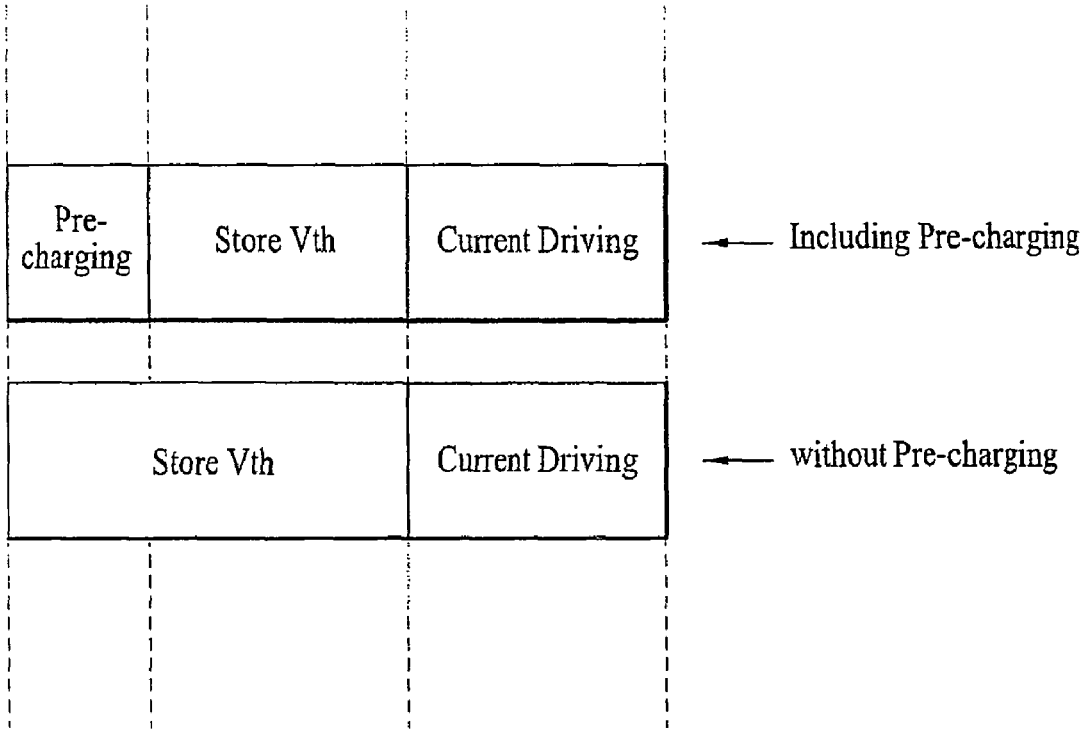
FIG. 7 is a conceptual diagram illustrating a method for driving a flat panel display when a pre-charging phase is omitted according to the present invention.

FIG. 7 is a conceptual diagram illustrating a method for driving a flat panel display when a pre-charging phase is omitted according to the present invention.

Referring to FIG. 7, the method for driving the flat panel display according to the present invention is classified into a first case having the pre-charging phase and a second case having no pre-charging phase.

The upper drawing of FIG. 7 represents the aforementioned first case having the pre-charging phase during the non-light-emitting time, such that the non-light-emitting time includes a pre-charging time and a time for storing the threshold-voltage.

The lower drawing of FIG. 7 represents the aforementioned second case having no pre-charging phase during the non-light-emitting time, and only the threshold voltage is stored during the non-light-emitting time.

The aforementioned second case includes a non-light-emitting time for storing the threshold voltage and a light-emitting time caused by the data-current writing operation.

As apparent from the above description, the method for driving the flat panel display according to the present invention has the following effects.

Firstly, the present invention acquires a constant current signal by compensating for a threshold-voltage deviation and a mobility deviation of the pixel's driving TFT, such that it increases uniformity and improves image quality. As a result, the present invention solves the pre-charging problems of the conventional current-drive method.

Secondly, the present invention allows the OLED to have a predetermined OFF time, and recovers characteristics of the OLED element. Also, the present invention reduces the influence of heat generated by power consumed by the OLED element, and delays deterioration of the element characteristics, such that it increases the lifetime of the OLED element.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for driving a flat panel display in cross-driving a plurality of data-lines comprising the steps of:

charging a pre-charging voltage to a storage capacitor connected to a first data-line during a non-light-emitting phase;

applying a data waveform signal to a pixel transistor of a second data-line, and allowing a pixel transistor connected to the first data-line to enter a floating state so that the storage capacitor stores a threshold voltage of the pixel transistor connected to the first data-line during the non-light-emitting phase;

applying a data waveform signal to the pixel transistor of the first data-line during a light-emitting phase;

wherein the pre-charging voltage is lower than the threshold voltage of the pixel transistor connected to the first data-line; and wherein the pixel transistor connected to the second data-line enters a floating state during at least one of the step of performing a pre charging operation of a first data line charging a pre-charging voltage to a storage capacitor connected to a first data-line during a non-light-emitting phase and the step of applying a data waveform signal to the pixel transistor of the first data-line.

2. The method according to claim 1, wherein the steps are repeatedly driven for each frame.

3. The method according to claim 1, wherein the step of storing a pre-charging voltage to a storage capacitor connected to a first data-line is executed before a waveform signal is applied to another data-line.

* * * * *